United States Patent [19]

Pasquin

[11] Patent Number: 5,005,225

[45] Date of Patent: Apr. 9, 1991

[54] DUAL FLUSH VALVE FOR WATER CLOSETS

[76] Inventor: John P. Pasquin, P.O. Box 25664, West Valley City, Utah 84125

[21] Appl. No.: 418,858

[22] Filed: Oct. 10, 1989

Related U.S. Application Data

[63] Continuation-in-part of Ser. No. 326,366, Mar. 21, 1989, abandoned.

[51] Int. Cl.[5] ..... E03D 1/14

[52] U.S. Cl. ..... 4/326

[58] Field of Search ..... 4/324–327

[56] References Cited

U.S. PATENT DOCUMENTS

| | | | |
|---|---|---|---|
| 1,780,810 | 11/1930 | Brown | 4/326 |
| 1,960,864 | 5/1934 | Brown | 4/326 |
| 4,096,591 | 6/1978 | Awis | 4/326 |
| 4,115,882 | 9/1978 | Paulus | 4/326 X |
| 4,185,338 | 1/1980 | Bresngan | 4/327 |
| 4,504,981 | 3/1985 | Burns | 4/326 |
| 4,557,000 | 10/1985 | Strangfeld | 4/324 |

FOREIGN PATENT DOCUMENTS

| | | | |
|---|---|---|---|
| 48112 | 12/1981 | Fed. Rep. of Germany | 4/324 |
| 2308740 | 11/1976 | France | 4/325 |

*Primary Examiner*—Charles E. Phillips

*Attorney, Agent, or Firm*—Trask, Britt & Rossa

[57] ABSTRACT

A dual flush valve assembly for use in the water storage reservoir of a conventional toilet is disclosed. The assembly includes a first valve, a second valve and an actuation arrangement adapted for controlling the opening and closing of those valves. The first valve is adapted for effecting a discharge of a first quantity of water, the second valve is adapted for discharging a second quantity of water. The first quantity of water is measurably smaller than the second quantity of water. The invention provides a means whereby the user may select the quantity of water discharged in a flush cycle according to the type of waste materials being disposed of.

14 Claims, 16 Drawing Sheets

DUAL FLUSH VALVE FOR WATER CLOSETS

This is a continuation-in-part application of Ser. No. 326,366 filed 21 Mar. 1989 and entitled "Dual Flush Valve for Water Closets," now abandoned.

BACKGROUND OF THE INVENTION

1. Field: This invention relates to valves adapted for channeling fluids. More specifically, this invention is directed to a flush valve assembly for use in conventional toilets.

2. Statement of the Art: Water is a critical necessity for the continuation of human life. As an increasing population places more demands on the already scarce supplies of water, efforts both in the private sector and in government agencies have been directed toward the more efficient use of this resource. One of the most quantity-demanding uses of present water supplies is that of waste disposal, specifically human waste disposal.

In the past few years, many approaches have been advanced for limiting the quantity of water required for effectively and safely disposing of human waste. In this vein, the art discloses several attempts directed to reducing the quantity of water utilized in the operation of conventional toilets. Simple attempts include the placement of bricks, weighted plastic bottles or other articles into the toilet's water storage reservoir. These efforts have principally focused on reducing the storage capacity of the reservoir and thereby limiting the quantity of water that is discharged per flush cycle. Other attempts have involved bending the arm which supports the float. The arm controls the water intake valve responsible for refilling the reservoir to an operating level. Alternative approaches have involved the use of baffles, placed either about the reservoir sidewalls or within the reservoir outlet, adapted for retaining water within the reservoir during flushing.

The aforesaid approaches have all been directed to reducing, by a constant amount, the quantity of water discharged from the toilet's reservoir per flush cycle. While on its face, this objective appears desirable, problems have arisen for the user of such approaches. In the past, toilets and the sewer pipelines associated therewith were designed using the flush capacity of the toilet's storage reservoir as a governing criteria. With the reduction in the quantity of water discharged during a flushing cycle, resulting from adoption of the above-described approaches, oftentimes the decreased quantity of water discharged in a normal flush cycle is insufficient to dispose adequately the waste materials in the toilet bowl through the residential sewer lines, and into the municipal sewer system. With repeated operation of the toilet, soon the residence's sewer lines became clogged, necessitating costly and unpleasant cleaning operations.

Resultingly, while the aforesaid approaches do achieve the objective of reducing the quantity of water consumed by toilet operation, on the other hand, these approaches oftentimes have proved themselves less than advantageous in that they created other problems, whose resolution is more expensive than the cost savings achieved through the conservation of water.

There continues to be a need for structures which can at once address the problem of conserving water in toilet operation, while simultaneously and adequately relaying the waste materials from the toilet bowl, through the residence's sewer lines to the community sewer system.

SUMMARY OF THE INVENTION

The invention discloses a dual flush valve assembly adapted for use with conventional toilet structures. The assembly provides the user with a means of manually selecting the quantity of water to be discharged from the toilet's water storage reservoir according to the quantity and type of waste to be disposed of.

The valve assembly is adapted for placement in a conventional toilet water storage reservoir which defines an outlet therein.

In one embodiment, the assembly may include two valve means mechanically associated with the outlet, adapted for opening and alternatively closing that outlet.

The opening of a first valve means is adapted to effect the discharge of a first quantity of water from the storage reservoir. The opening of the second valve means effects the discharge of a second quantity of water from the reservoir. The second quantity of water is measurably larger than the first quantity of water and may, in many instances, correspond volume-wise with the quantity of water discharged during the flush cycle of an unaltered conventional toilet. The first quantity of water, in contradistinction, is significantly smaller volume-wise. In use, the flush cycle which utilizes the second quantity of water is directed toward evacuating the toilet bowl of solid waste materials, e.g. fecal matter. The flush cycle, utilizing the first quantity of water, is directed to cleansing the bowl of liquid waste material, e.g. urine.

The invention includes an actuation means adapted for actuating the two valve means independently of one another. Alternatively, the actuation means may be adapted for operating the two valves in conjunction with one another.

In another embodiment, the invention includes one valve means adapted for opening and closing the reservoir outlet. The actuation means, associated with the sealing means, is adapted to physically retain the sealing means in an open position for different periods of time according to the volume of water selected to be used in a particular flush cycle. For example, in those instances wherein liquid waste (e.g. urine) is to be disposed of, the actuation means retains the valve means open for a shorter period of time than when solid waste is to be evacuated from the toilet bowl.

The invention therefore provides the user with a means of selecting an optimal quantity of water for use in evacuating a given quantity and type of waste material from the toilet bowl, thereby conserving water. Further, since the invention retains the volume discharge for which the toilet and its associated sewer lines were originally designed, the likelihood of sewer lines clogging as a result of insufficient quantities of discharged water pressure acting on the waste to be evacuated is markedly reduced, if not eliminated.

DETAILED DESCRIPTION OF THE DRAWINGS

Figure 1:
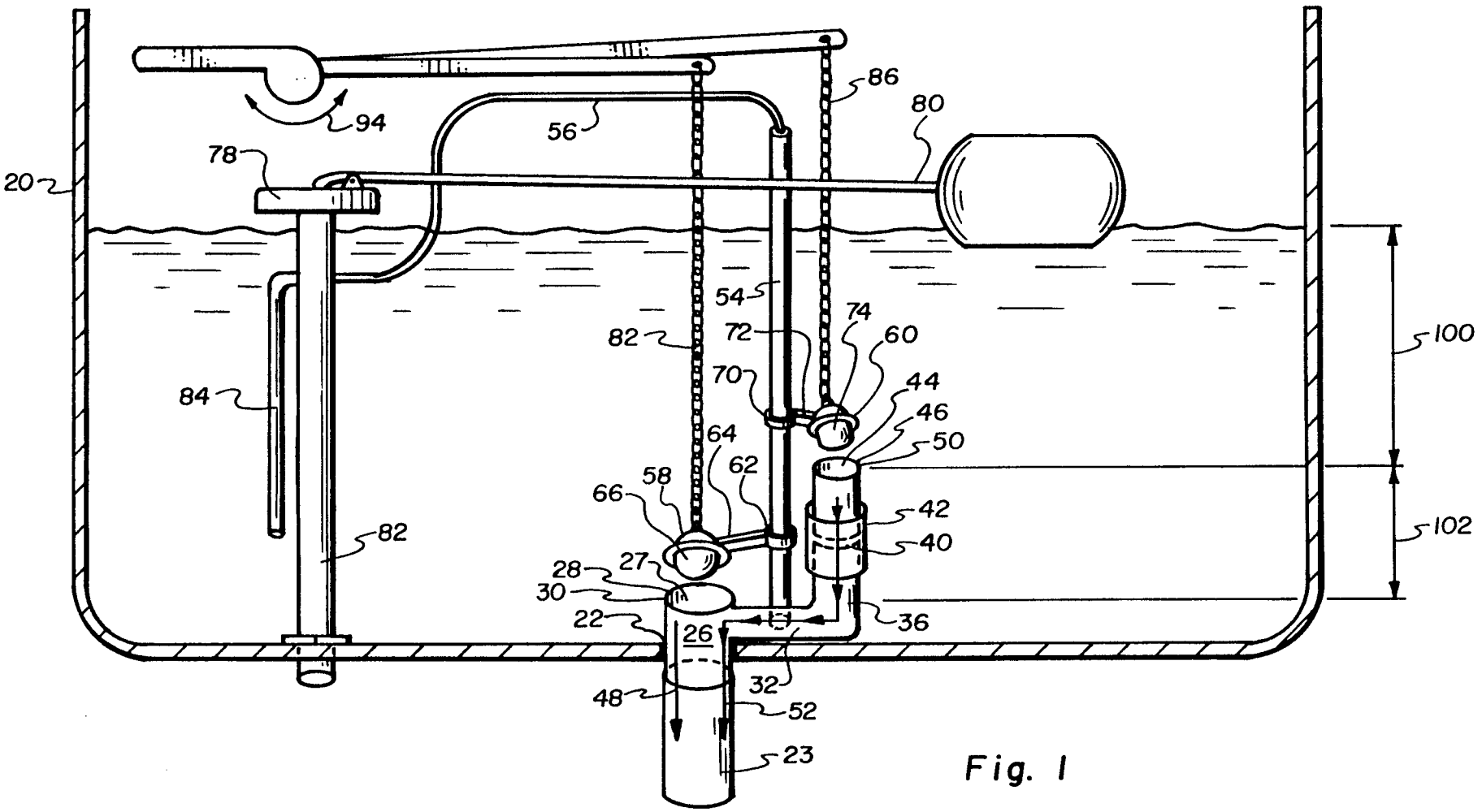
FIG. 1 is a frontal cut-away view of a toilet water storage reservoir showing a first embodiment of the flush valve of the invention.
Figure 7:
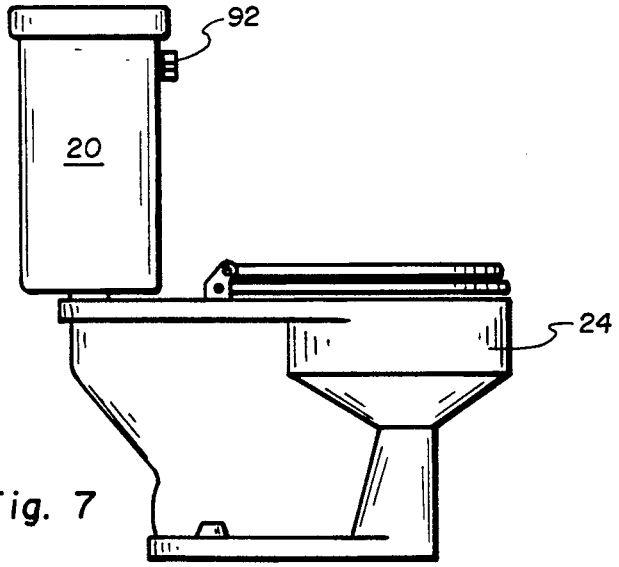
FIG. 7 is a side view of a toilet showing the placement of the water storage reservoir.

With more specific reference to the drawings, and FIG. 1 in particular, a water storage reservoir, generally 20, configured to contain a quantity of water defines an outlet opening 22 therein which empties into conduit 23 leading to the bowl 24 of the toilet. The reservoir is positioned elevationally above the bowl to take advantage of a gravity-induced flow of water from the reservoir 20 into the bowl 24 (FIG. 7).

Sealedly positioned within outlet 22 is an upright, tubular, open-ended conduit 26. The conduit 26 defines an interior channel 27 which communicates with conduit 23 on the lower open end of the conduit 26 and with the contents of reservoir 20 on the conduit 26's upper open end. The upper end 28 of conduit 26 defines a valve seat 30.

Figure 2:
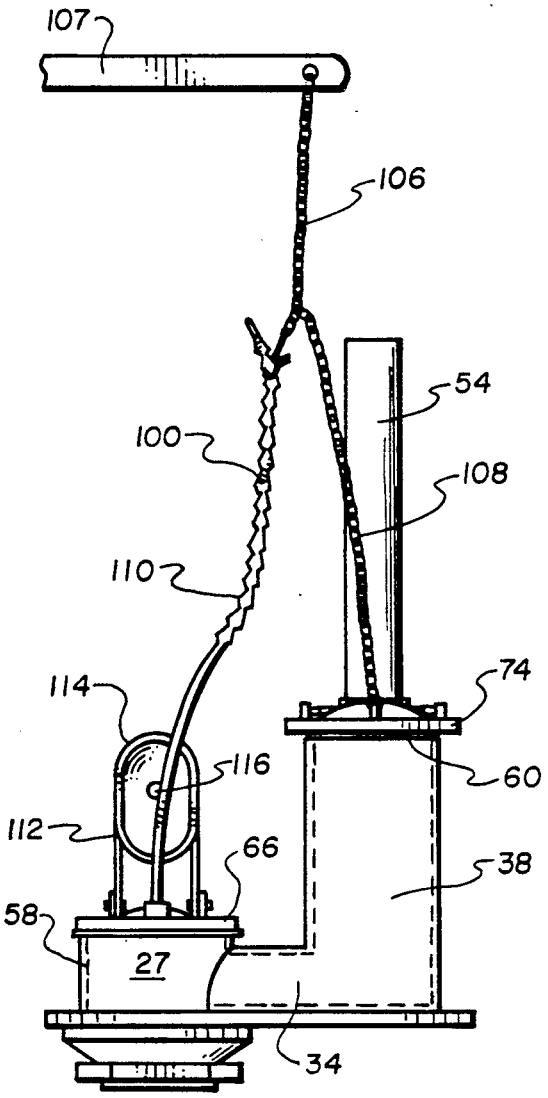
FIG. 2 is a front elevational view of a flush valve of the invention.
Figure 3:
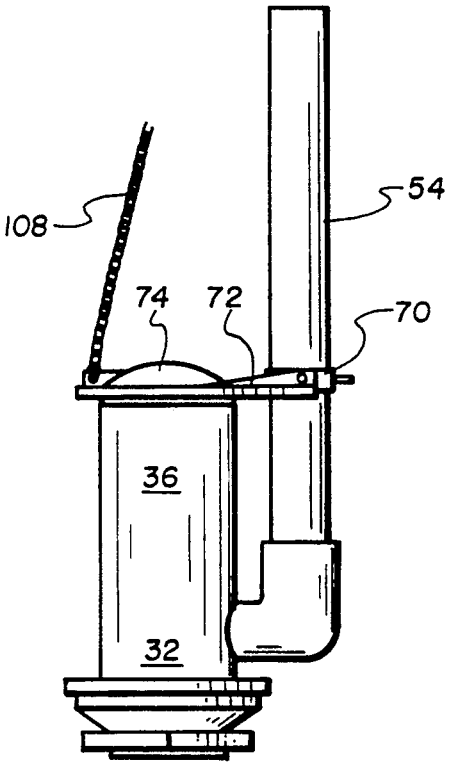
FIG. 3 is a side view of the flush valve of FIG. 2.
Figure 4:
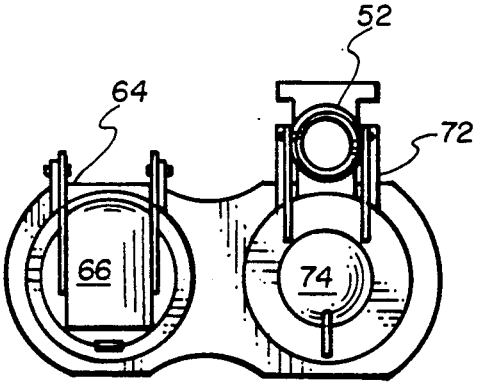
FIG. 4 is a top view of the valve of FIG. 2.
Figure 5:
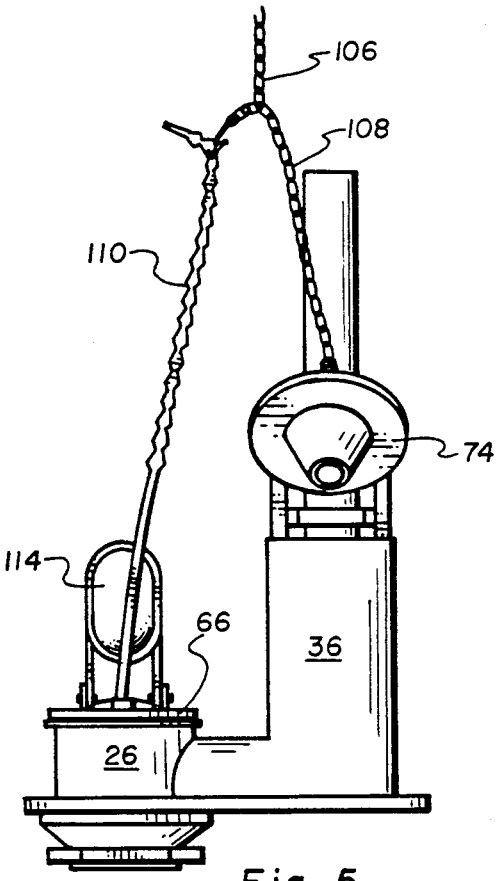
FIG. 5 is an elevational view of the valve of FIG. 2.
Figure 6:
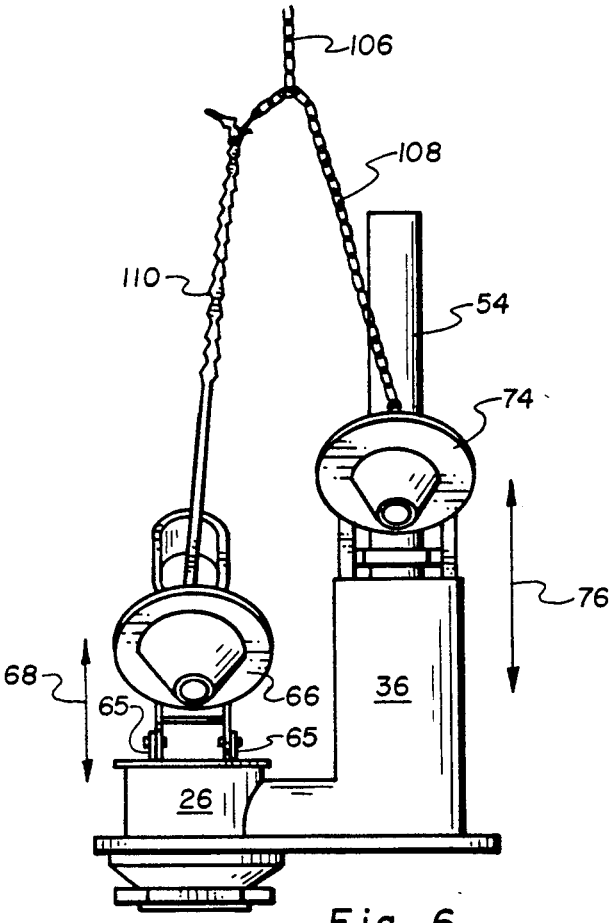
FIG. 6 is an elevational view of the valve of FIG. 2.

Mounted within the sidewall of conduit 26 is a laterally extending second cylindrical conduit 32 which defines an interior channel 34 therein (FIG. 2). The channel 34 communicates with the channel 27 on its first end. Mounted uprightly on the free end of conduit 26 is a third tubular conduit 36, which defines an interior channel 38 therein. Channels 38 and 34 communicate one with another.

The free end 40 of conduit 36 is received with an elastic, tubular, sleeve-like cylindrical member 42 which defines a hollow interior channel which extends completely along its length. An upright fourth tubular conduit 46 is received within the opposing open end of sleeve member 42. Conduit 46 likewise defines an interior channel 44 which extends completely along its length. The assembly of conduits defines a dual flow path manifold. The first path extends from valve seat 30 downwardly through outlet opening 22 into conduit 23, as indicated by arrow 48. The second flow path extends from a valve seat 50, defined on the end of conduit 46, downward through conduits 46, sleeve 42, conduit 36, conduit 32, conduit 26 (in that order) and thereafter through outlet 22 to conduit 23. The general flow direction of the first flow path is illustrated by arrow 52.

Mounted within the sidewall of conduit 32 is an uprightly mounted auxiliary water supply pipe 54. Pipe 54 is adapted to receive water from a supply line 56 and direct the water into conduit 32 during the flushing operation. In the embodiment shown in FIG. 1, the supply pipe 54 functions as a support structure for two plug-like valves, respectively 58 and 60.

Valve 58 includes a collar 62 firmly mounted to the exterior surface of pipe 54 and an arm 64 pivotedly mounted to collar 62. A plug valve head 66, mounted on the free end of arm 64, is configured to engage valve seat 30 and form a water-tight sealed closure of conduit 26. Plug 66 in association with arm 64 is angularly displaceable about its pivot mounting on collar 62 as shown by arrows 68.

In a second valve 58 construction, illustrated in FIGS. 2-6, the arm 64 may be pivotedly mounted to a support structure, e.g. a pair of upstanding arms 65 mounted on a bar structure 67. As illustrated, the base structure 67 is a generally planar construction which forms a base for the mounting of the values 58 and 60.

Referring again to FIG. 1, valve 60 is structurally similar to valve 58, that is, it includes a collar 70 mounted on pipe 54, an arm 72 pivotedly mounted to collar 70 mounted on pipe 54, an arm 72 pivotedly mounted to collar 70 and a plug valve head 74 mounted on arm 72. The plug 74 is configured to be inserted into valve seat 50 to form a water-tight sealed closure of the conduit 46. Similar to valve 58, the plug 74 and arm 72 are adapted to be angularly displaceable about their pivot mounting on collar 70 in the directions indicated by arrows 76.

Water supply line 56 is mounted to an inlet water valve 78 which is actuated by a float-fitted arm 80. Valve 78 includes two supply lines for introducing water received through inlet conduit 82. The aforedescribed line 56 introduces water into conduit 32 through means of pipe 54. A second supply line 84 introduces water directly into the reservoir 20 itself.

Plug valve head 66 is fitted with a chain 82 which extends upwardly to a mounting on a laterally extending elongate lever arm 158. Likewise, plug valve head 74 is fitted with a chain 86, which extends upwardly to a mounting on a laterally extending elongate lever arm 156.

The lever arms 158 and 156 are each mechanically associated with a handle 92 which is journaled through the sidewall of the reservoir 20. Handle 92 is angularly rotatable in the directions indicated by arrows 94 and includes an extension 96 thereof which is configured figured to be grasped by the user. A more detailed description of the mounting of the lever arms 158 and 156 on handle 92 will be undertaken later in the disclosure.

The quantity of water discharged from the storage reservoir 20 upon an opening of either the plug valve 58 or the plug valve 60 is a function of the cross-sectional area of the reservoir and the height of the water above the respective valve seat of a given valve. For example, in FIG. 1 for the valve 60, the volume of the discharge would be given by the reservoir cross-sectional area multiplied by the height designated !00. The volume of the discharge for valve 58 would be that same cross-sectional area multiplied by the sum of height 100 and height 102. The volumetric difference in the two flush volumes would be given by the product of the cross-sectional area multiplied by height 102.

Due to the sleeve 42 construction, the heights 100 and 102 may be varied by the user. To decrease the volume of the flush discharge effected by valve 60, the conduit 46 may be eased upward from the sleeve 42, thereby elevating the valve seat 50. Understandably, the sleeve 42 likewise may be displaced upwards along the height of conduit 36 to further elevate the valve seat 50. To increase the volume of the flush discharge effected by an opening of valve 60, the conduit 46 may be displaced downward into the sleeve 42 and, further, that sleeve 42 may be displaced downward over the conduit 36.

FIG. 2 illustrates a chain arrangement 100 adapted for connecting the two plug heads 66 and 74 to a single actuation lever. In this construction, a main support chain 106 is mounted on a single lever 107 mounted to the handle 92. A chain 108 is mounted on plug head 74 extending upwards to a mounting on main chain 106. A chain 110 or other flexible member, e.g. a rubber cord, is mounted on plug head 66 and extends upward to a mounting on the main chain 106. The chain 110 is dimensioned such that sufficient slack is provided whereupon a first upward displacement of chain 106 initially engages plug 74, thereby opening valve 60 while valve 58 remains closed. A second upward displacement of chain 106 beyond the first displacement takes up the slack in chain 110, thereby causing the chain's 110 engagement and opening of plug head 66.

In the construction shown in FIG. 2–6, the operation of the valves 58 and 60 are controlled by the length of the chains 108 and 110. The length of chain 108 is dimensioned such that upon a given downward displacement of handle extension 96 and the resultant counterclockwise angular rotation of lever 107 about its axis of rotation defined by handle 92, i.e. the upward displacement of lever 107, the valve is opened while the length of chain 82 is such that the counterclockwise rotation of lever 84 which accompanied the rotation of lever 90 is not of sufficient magnitude to open the valve 58. A further counterclockwise rotation of the lever 107 eventually causes the valve 58 to open. Observably, with a first rotation of the lever only the valve 60 is opened, thereby yielding a first flush discharge of the above-described volume. Should the use require a larger flush volume, a further displacement of the handle causes the valve 58 to open, yielding the flush volume which is substantially equivalent to the entire volume of the reservoir.

FIG. 2 illustrates a plug head 66 having a delay means 112 mounted thereon. This delay means 112 is adapted for retaining the valve 58 open, i.e., the plug 66 disengaged from the valve seat 30 until the descending water level is displaced to the height of the valve seat 30. The delay means 112 includes an open-topped container 114 having an aperture 116 defined through the bottom wall of the container. As the plug head 66 is pulled upward the container 114 is oriented upright and remains full of water. As the water level descends below the container 114, the weight of the water in the container urges the plug head 66 to rotate backward away from its valve seat 30. As the water drains from the container 114 through aperture 116, the weight of the container decreases until the weight of the plug 66 overcomes the restraining action of the container 114, thereby urging the valve plug head 66 back into a closing engagement with its valve seat 30.

This type of plug head containing such a delay may be effectively used to cause a discharge of the water in the reservoir to the water level corresponding to the elevation of the valve seat 30. In preferred embodiments, this type of container-fitted plug may be utilized for both valve plug heads 66 and 67.

Figure 8:
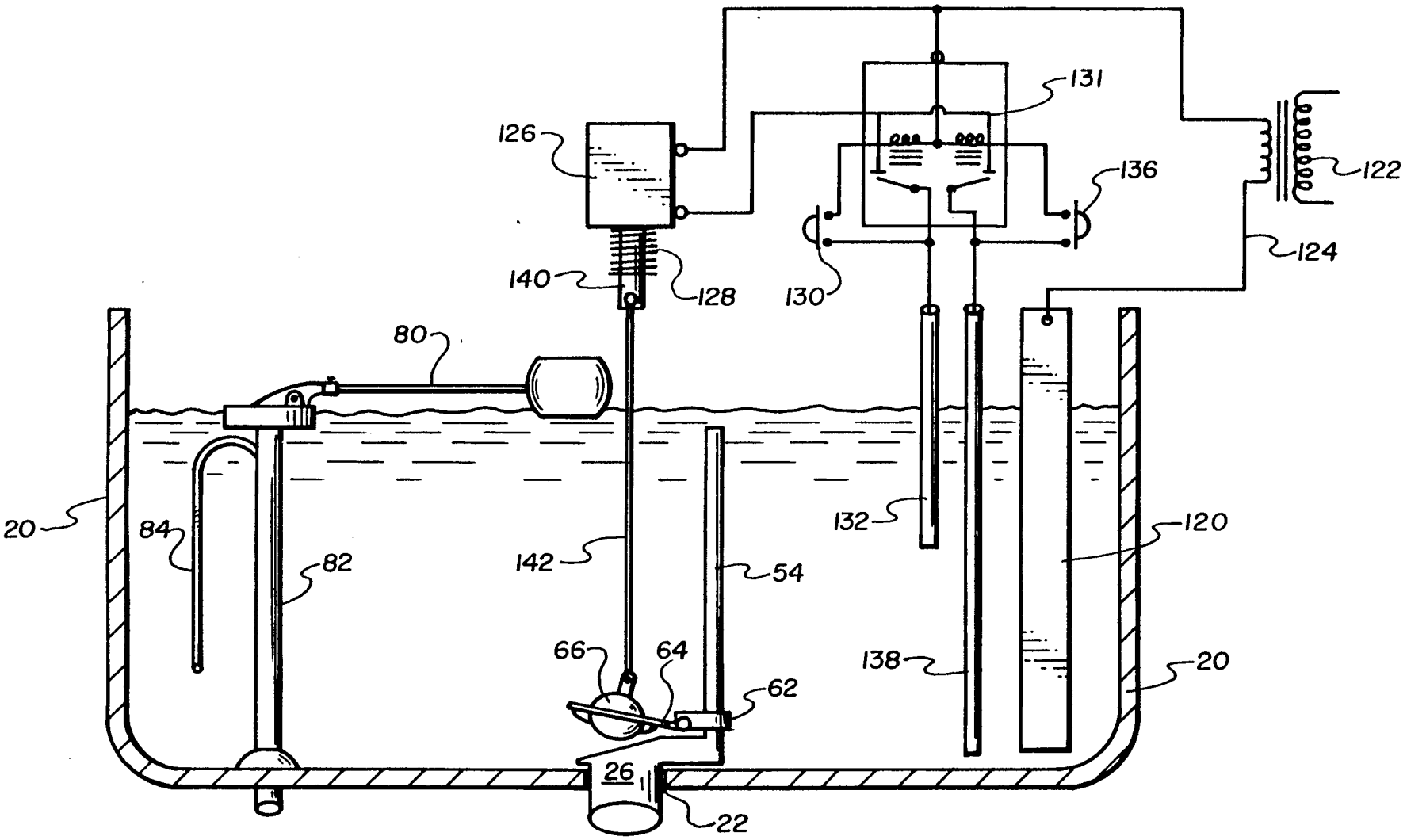
FIG. 8 is a frontal cut-away view of a toilet water storage reservoir showing a second embodiment of the invention.
Figure 9:
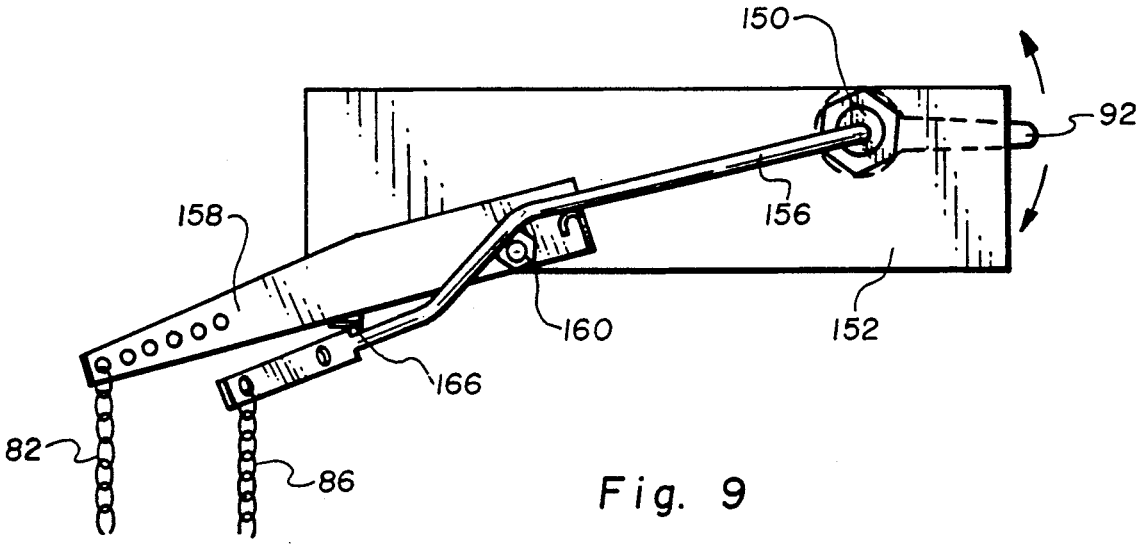
FIG. 9 is an elevational view of a preferred actuation means of the invention.
Figure 10:
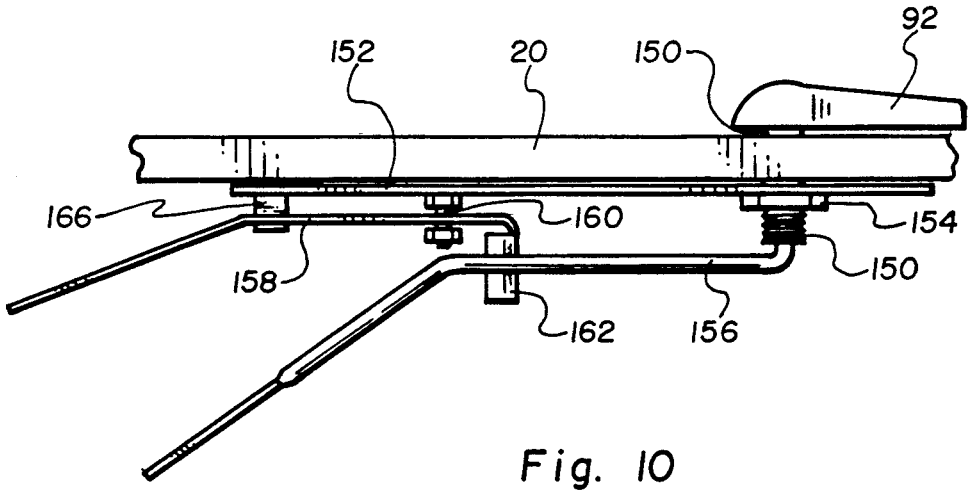
FIG. 10 is a top view of the elevation means of FIG. 9.

FIG. 8 illustrates an embodiment of the invention wherein the mechanical operation and function of a two-valve construction has been replaced by a single valve construction in association with an electrical actuation means. As shown, an anode 120 is submerged in reservoir 20 to extend substantially through the depth of that reservoir. The anode is connected to a source of power, e.g. a transformer 122 or battery by wire 124. The power source is wired to a low voltage solenoid 126 having a return spring 128 mounted thereon. Solenoid 126 is wired through a latching relay 131 to a parallelly wired switching arrangement. A low volume switch 130 is wired to a probe 132 which extends downward a selected distance into the reservoir. The high volume switch 136 is wired to a longer probe 138 which likewise extends downward into the reservoir. The volume of the flush discharge effected by each switch is determined by the length, i.e., the height of its respective probe activating the relay 151 and urging the solenoid to open the valve plug head 66. The pressing of a given switch closes a circuit, as electricity passes between the anode and the respective probe. Upon the water level's descent to an elevation below the probe, the circuit is broken and the solenoid valve armature is returned to its rest position by spring 128.

As shown, the solenoid valve armature 140 is connected by a connecting rod 142 to a pivotedly mounted plug head 66.

FIGS. 9–12 illustrate a preferred actuation means construction. As shown, the handle 92 includes an elongate threaded shaft support 150 which is journaled through a support plate 152. The shaft 150 support is retained in place by its threaded engagement with nut 154. A lever 156 is fixedly mounted on shaft 150. The free end of lever 156 defines one or more openings adapted to retain a chain 86 which is secured at its opposing end to plug 74. A second bell crank type lever 158 is pivotedly mounted to the support plate 152 by a nut-fitted shaft 160. Lever 158 is fitted on its free end with a plurality of openings adapted to engage and retain a chain 82 which is mounted on its opposing end to plug head 66.

Lever 158 includes an outwardly extending flange 162 which is positioned to engage lever 156 upon a downward displacement of that latter lever.

Figure 11:
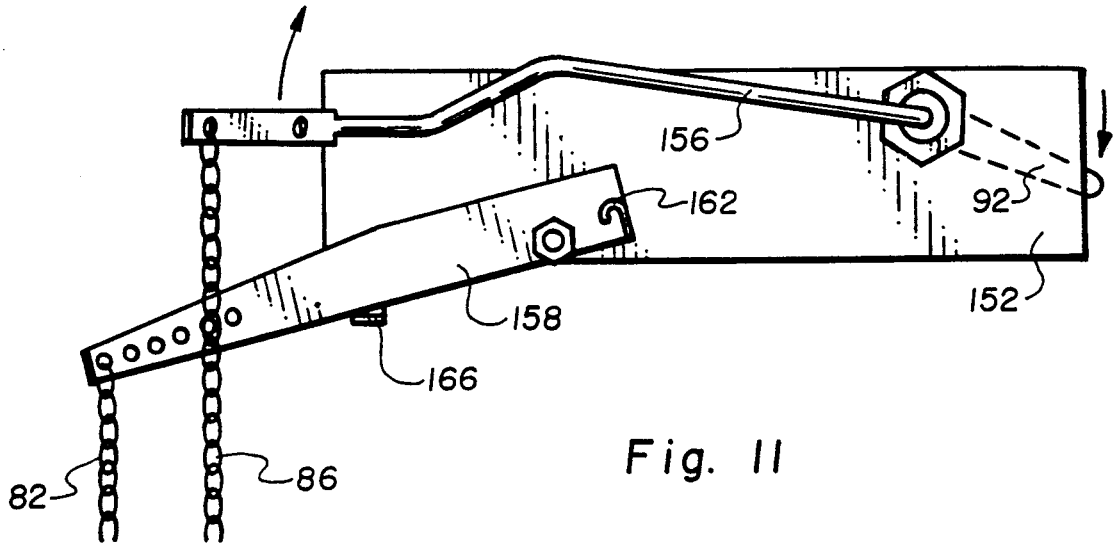
FIG. 11 is an elevational front view of the actuation means of FIG. 9 shown in a first actuating condition.

As shown in FIG. 11, a downward (i.e. clockwise rotation) of the handle 92 causes a corresponding clockwise rotation of lever 156, thereby causing an upward displacement of the free end of that lever 156 effecting an opening of valve 60.

Figure 12:
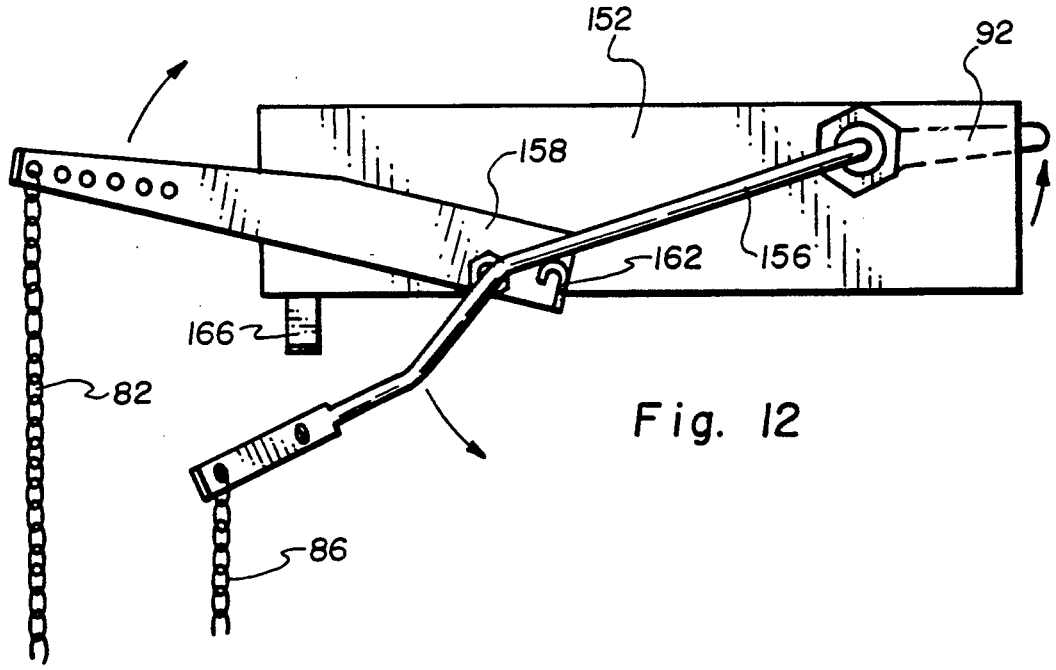
FIG. 12 is an elevational front view of the actuation means of FIG. 9 shown in a second actuating condition.
Figure 13:
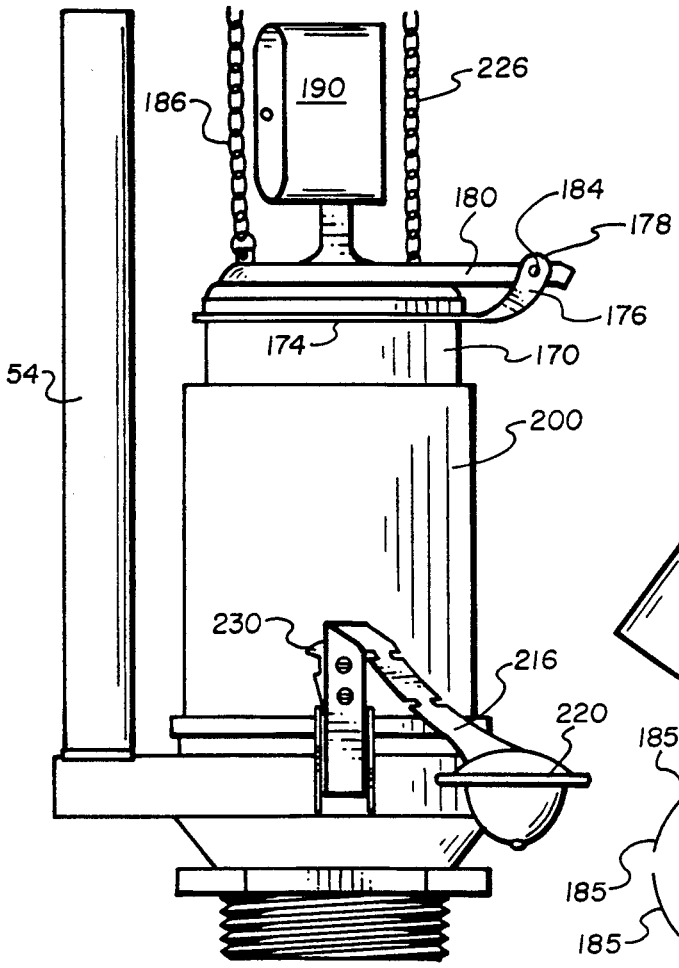
FIG. 13 is a side elevational view of a third embodiment of the, invention.

FIG. 12 illustrates a counterclockwise displacement of the handle 92 which causes the lever 156 to engage the flange 162 of lever 158, thereby effecting a clockwise rotation of lever 158 and a corresponding opening of valve 58.

Support plate 152 is retained in position on reservoir 20 by the shaft support 150.

As shown, lever 158 is retained in a rest position by a laterally extending support leg 166.

In this particular construction, the valves 58 and 60 are operated independently from one another, i.e., each flush is resultant from the opening of only one valve. Given the different rotations of the handle 92 required to effect the different flushes, the user may easily control the type of flush cycle obtained.

FIGS. 13–18 illustrate a third embodiment of the invention. In this particular embodiment, the valving arrangement includes a first elongate, annular tubular conduit 170 which defines a hollow linear channel 172 which extends through the length of the member. A support mounting 174 is mounted on the exterior surface of the member 170 proximate its upper end. The support mounting 174 includes a clevis 176 having two forks 178 positioned spacedly apart from one another. Positioned between the forks 178 is the arm 180 of a plug valve head 182 which structurally approximates the head 74 previously described. The arm 180 is pivotedly mounted to the forks 178 by an elongate pivot axle 184 retained in opposingly positioned apertures defined in the forks 178. Due to the pivot mounting on forks 178, the valve head 182 may rotate in a vertical plane in the directions shown by arrow 185. An actuation chain 186 is mounted to valve head 182 on its proximal end 188 at a location on the valve head 182 substantially opposite to the arm 180's mounting on forks 178. Chain 186 may be connected to a handle lever arrangement similar to those illustrated in FIGS. 1 and 912.

Similar to the valve head 66, valve head 182 may be fitted with a container 190 corresponding in function and operation to container 114. Container 190 also includes an aperture therein corresponding to aperture 116 in container 114.

Figure 14:
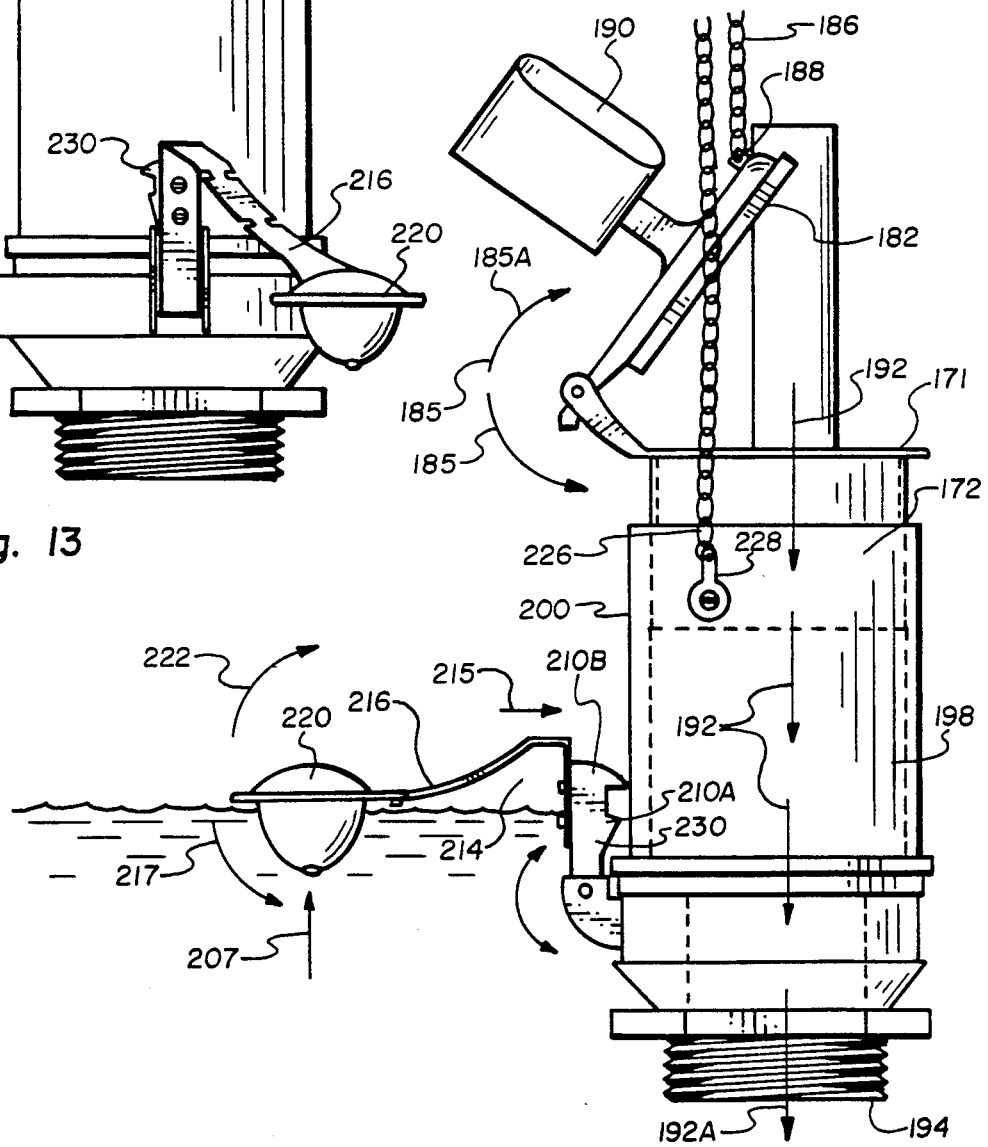
FIG. 14 is a front elevational view of the third embodiment with the first valve in an open condition.
Figure 15:
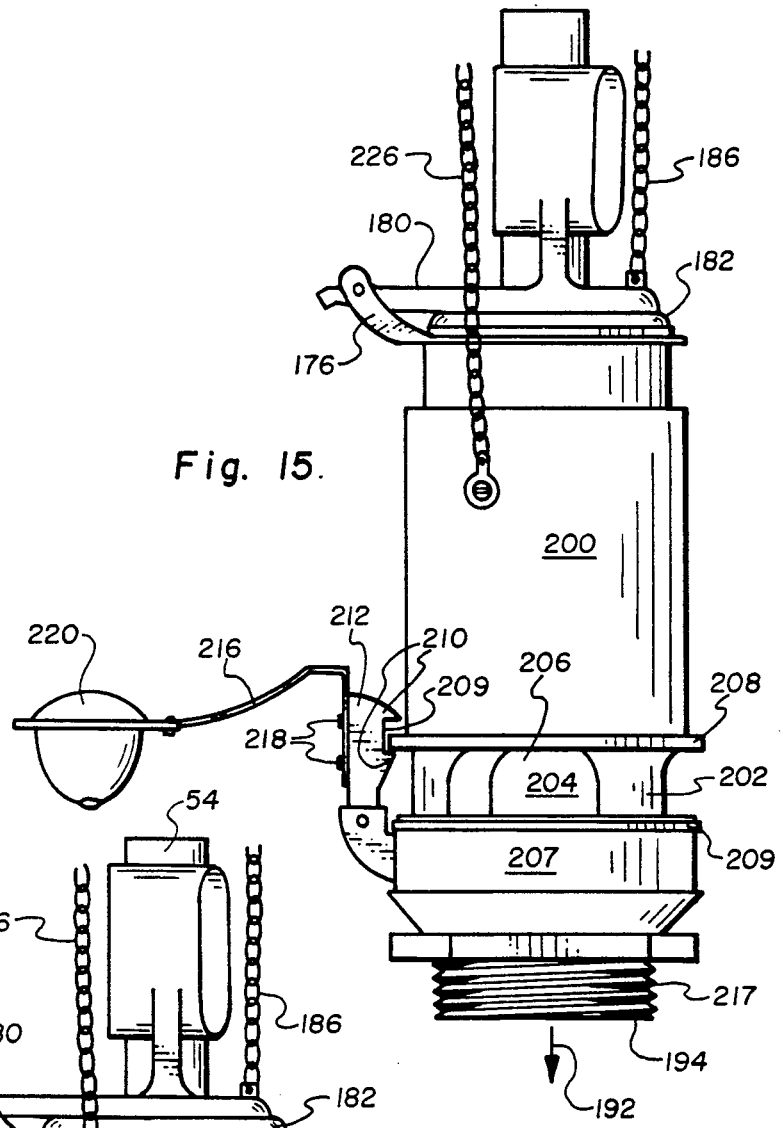
FIG. 15 is a front elevational view of the third embodiment with the second valve in an open condition.
Figure 16:
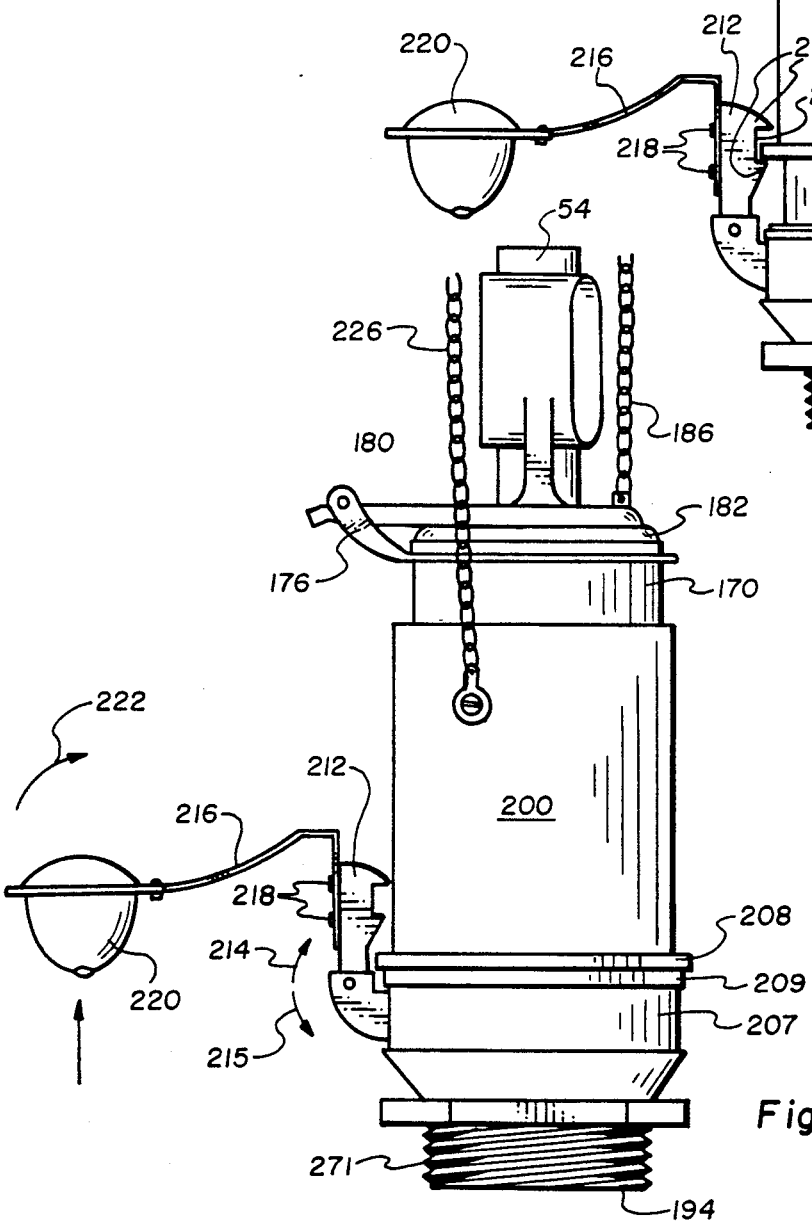
FIG. 16 is a front elevational view of the third embodiment with the first and second valves both in a closed condition.
Figure 17:
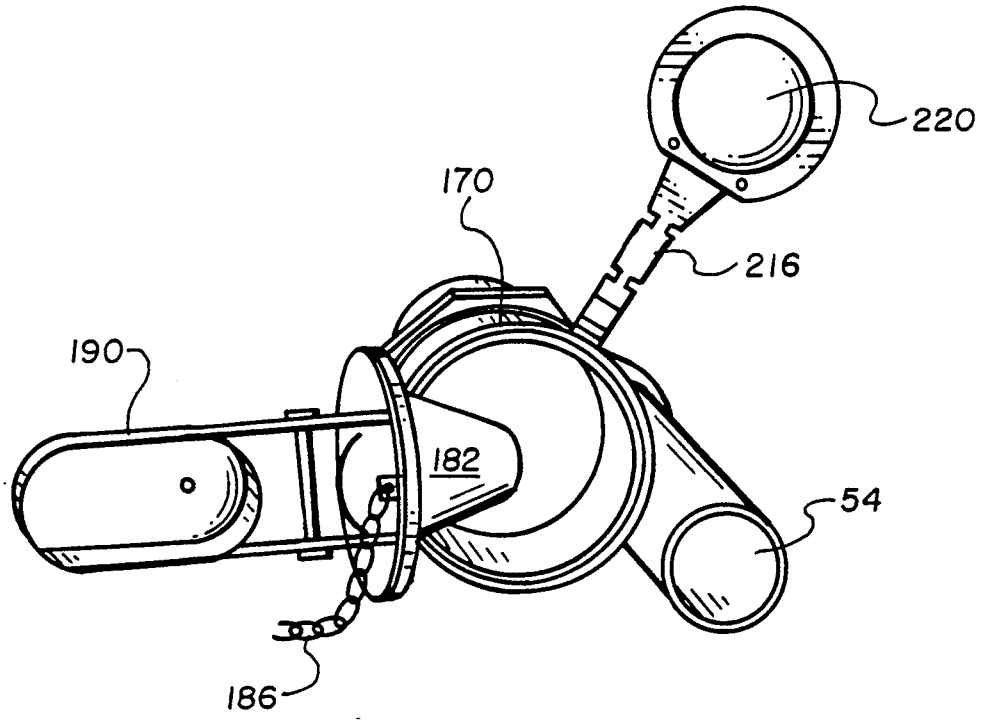
FIG. 17 is a top view of the third embodiment with the first valve in an open condition.

Upon an angular displacement of a valve head 182 about its axis 184 i.e., as shown in FIG. 14, the open end or port of tubular conduit 170 is exposed, permitting water in the reservoir to enter the hollow linear channel 172. The water then may flow directly downward as shown by arrow 192, eventually entering water outlet 194 and thereafter being directed by the channeling of the toilet itself into the toilet bowl as shown by arrow 194. An angular rotation of the valve head !82 in the direction indicated by arrow 185A closes the port of the tubular conduit 170.

The tubular conduit 170 is mounted coaxially within a hollow, cylindrically-shaped channel 198 defined by a second annular shaped tubular conduit 200. Channel 198 extends the entire length of the member 200 and communicates with the opposing open ends of the member 200. The member 170 may be fixedly mounted to the member 200, by adhesives, or other mechanical-type fittings, e.g. bolts or screws. Alternatively, and preferably, the members 170 and 200 are sized to provide a pressure-fit union, whereby the member 170 is generally retained in a selected orientation vis-a-vis the member 200, but also, that orientation may be modified by either inserting the tubular conduit further into channel 198 or alternatively, retracting the member 170 somewhat from the channel 198. By reorienting the tubular conduit 170, the user is able to adjust the elevation of the open port or end 171 of the member 170 and thereby control the amount of water discharged through that port when the valve head 182 is opened.

Figure 18:
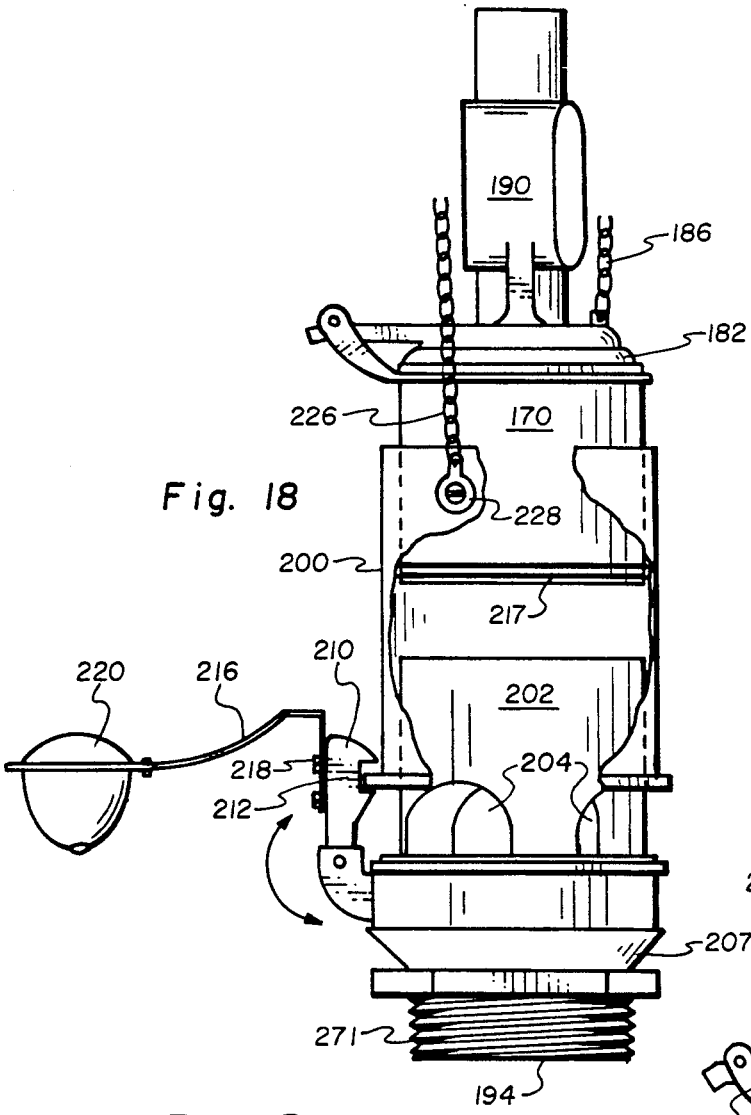
FIG. 18 is a front elevational view of the third embodiment of the invention partially in section, with the first valve in a closed condition, and the second valve in an open condition.
Figure 18A:
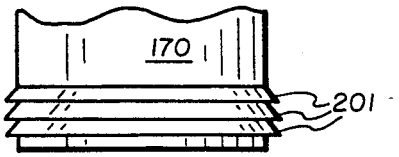
FIG. 18A is a sectional view of a tubular conduit of the invention shown fitted with machined fins.

Preferably, the mounting of member 170 within member 200 is sufficiently close as to preclude any flow of water downward between the two members, i.e., on the interface of the two tubular conduits As shown in FIG. 18, the interface between members 170 and 200 may be sealed by an elastomer "O"-ring 201 mounted about the lower end of member 170. The "O"-ring is dimensioned to extend outward sufficiently to contact the inner wall of member 200 and form a seal between the two members. In an alternate construction, the "O"-ring may be replaced by a series of semi-rigid fins which encircle the exterior surface of the member 170 similarly to the previously described "O"-ring (see FIG. 18A) and extend to engage the inner wall of member 200 to form a sealing engagement. The fins may be formed by machining the exterior surface of member 170. Mounted within the lower region of channel 198 and coaxially with members 170 and 200 is a third annular, elongate tubular conduit 202 which likewise defines a hollow interior channel 204 which extends along its entire length. Channel 204 extends between two opposing open ends defined by member 202. In contrast to tubular conduits 170 and 200, the sidewalls of tubular conduit 202 defines a plurality of apertures or slots 206 which communicate the environment with the interior channel 204. As shown to advantage in FIGS. 15 and 18, these apertures may be semicircular in configuration. As shown in FIGS. 13–18, the sidewalls of members 170 and 200 are solid structural members. Tubular conduit 202 is fixedly mounted on base support 207.

The channel 172 is dimensioned such that tubular conduit 200 is slidably displaceable over and along tubular conduit 202, i.e., tubular conduit 200 is displaceable vertically, both upwardly and downwardly over the conduit 202. The tubular conduit 202 has a sufficient height to form a support guide for the upward and downward displacement of the member 170 whereby the tubular conduit 200 is retained in a coaxial relationship with tubular member 202. Mounted proximate the lower end of tubular conduit 200 is an annular flange 208 which is shown as extending completely about the circumference of member 200. Flange 208 is adapted to engage an annular valve seat 209 mounted on base support 207 to form a liquid-tight seal of the valve. Upon the conduit 200 being raised and the flange 208 being withdrawn from engagement with valve seat 209, the valve is open and water from the tank may flow through apertures 204. Flange 208 is sized to be received within a recess well formed by the jaws 210 of a latch 212. Latch 212 is pivotedly mounted to a support 214 which is fixedly mounted to the bar support 206. The latch 212 is adapted for movement in the directions indicated by arrows 214 and 215. The latch 212 is biased against tubular conduit 200 by the action of a float fitted arm 216 which is mounted to the latch 212 by screws 218. Float 220 contains a quantity of air and thereby creates a buoyancy-induced moment about the latch 212 in the direction indicated by arrow 222 when the float 220 is positioned below the surface level of water in the water storage reservoir.

Float 220 is positionable between a maximum elevation wherein it is above the lowermost regions of apertures 206 and a minimum elevation which is approximately level with the lowermost regions of the apertures 206. When the valve is mounted within the toilet water storage reservoir and that reservoir is filled with water, the float is urged upwards by buoyancy (see arrow 207) and thereby causes a moment on the latch 212. The latch 212 in turn is biased against the tubular conduit 200.

Arm 216 is fabricated from a semi-rigid, yet bendable material such as metal. Recognizing that the float 220 controls the actuation of the valve latch 242, the routineer will recognize that by bending the arm 216 and thereby positioning the float 220 at a selected orientation, the user can actually control the volume of water being discharged through the valve during a flush cycle. By bending the arm 216 upward, and thereby raising the float 220 to a higher elevation, the user produces a smaller flush volume. In contrast, by bending the arm downward, and thereby lowering the float 220, the user produces a larger flush volume. Implicit is the recognition that the actuation of latch 212 is dependent on the water level in the tank being drawn down below the level of the float 220 while the latch 212 engages the valve section 244. The invention provides a means of infinitely varying the flush flow volume by bending the arm and thereby readjusting the orientation of the float vis-a-vis the latch 212. Understandably, the material making up the arm 216 is of sufficient rigidity that it will hold the float rigid vis-a-vis the latch 242 during operation once the arm has been bent into a given orientation by the user.

The tubular conduit 200 is fitted with an actuation chain 226 which is shown mounted at its proximal end to a sidewall of member 200 by a screw and bracket arrangement 228. The distal end of chain 226 may be mounted to an actuation handle lever such as those illustrated in FIGS. 1 and 9–12. Upon an upwardly-directed displacement of that chain 226, tubular conduit 220 is displaced vertically upwards, thereby exposing apertures 206. The water in the reservoir then flows through those apertures into channel 204 and then downwardly through base support 207 and through the water outlet 194 as shown by arrow 192A.

As the tubular conduit 200 is further raised, the flange 208 impacts against an angulated section 230 of latch 212. As the tubular conduit 200 is further elevated, the latch 212 is urged against the buoyancy-induced moment generated by the float 220, away from the tubular conduit 200 in the direction illustrated by arrow 214. Once the flange 208 clears the first jaw 210A, the force of moment 222 urges the latch in the direction indicated by arrow 215, thereby locking the flange 208 within recess well 210. Further upward movement of the tubular conduit 200 is restrained by the second jaw 210B.

As the water continues to be evacuated from the reservoir by flowing through apertures 206, the water surface level eventually sinks below the maximum height of the float 220. As it does, the mass of that float, under the force of gravity, causes a moment about the latch in the direction indicated by arrow 215. Eventually that moment causes a rotation of latch 212 in the direction indicated by arrow 215. When the latch rotates beyond an orientation wherein the lower jaw 210A no longer abuts against the flange 208, gravity then operates on the tubular conduit 200 to cause it to descend vertically until it abuts against the base support 207 and thereby obtains a rest position. As tubular conduit 200 abuts against the base support 207, it seals, water-tight, any access to the interior channel 202 and hence access to the apertures 206, thereby preventing any water from accessing the water outlet 194 in the base support.

In this embodiment, the flow path for water from the storage reservoir to the water outlet 194 is substantially vertical and linear for the first valve, i.e. the valve defined by tubular conduit 172 and valve head 182. This particular configuration minimizes energy loss from the flowing water due to surface drag, and further contributes to optimizing the water's flow rate through the water outlet.

When the second valve is opened, i.e., when tubular conduit 200 is vertically raised, exposing apertures 206, tubular member 172 is also elevated together therewith without necessarily opening the first valve, i.e., opening valve head 182.

Figure 19:
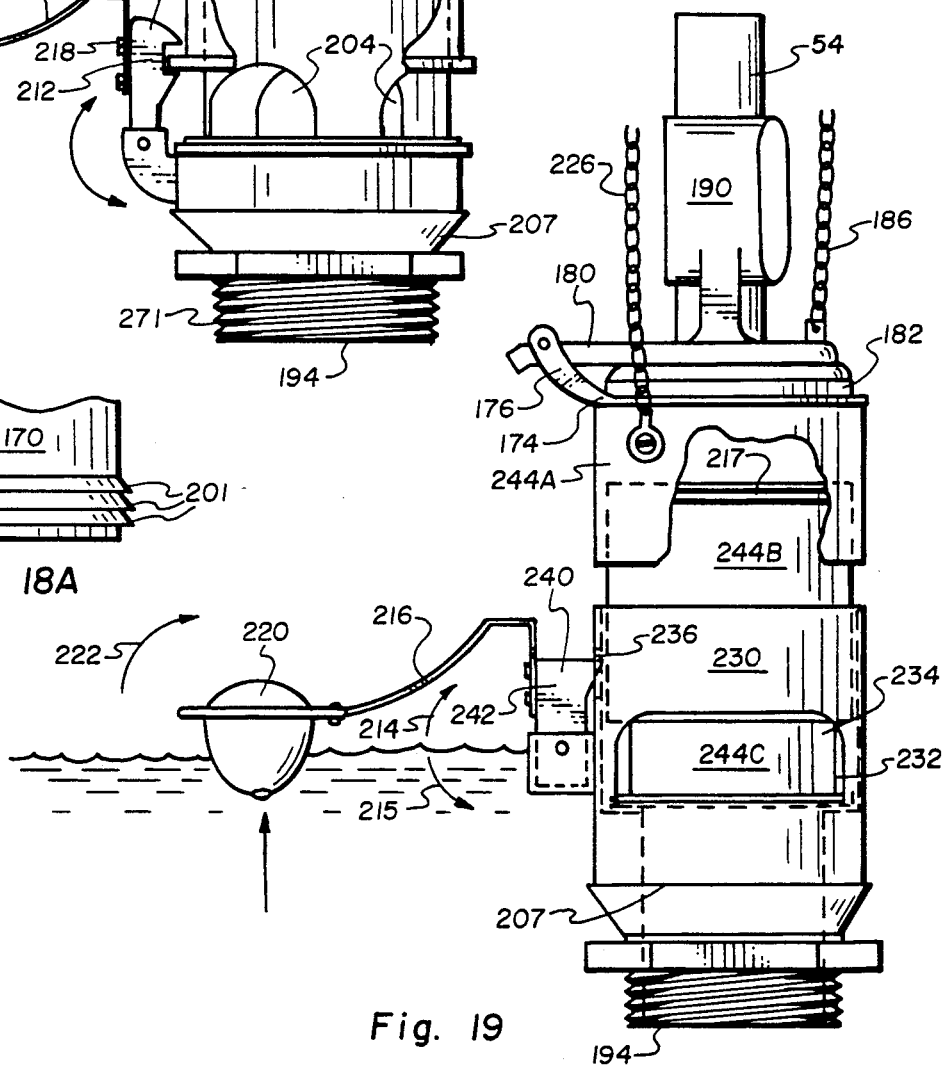
FIG. 19 is a front elevational view of a fourth embodiment of the invention.
Figure 20:
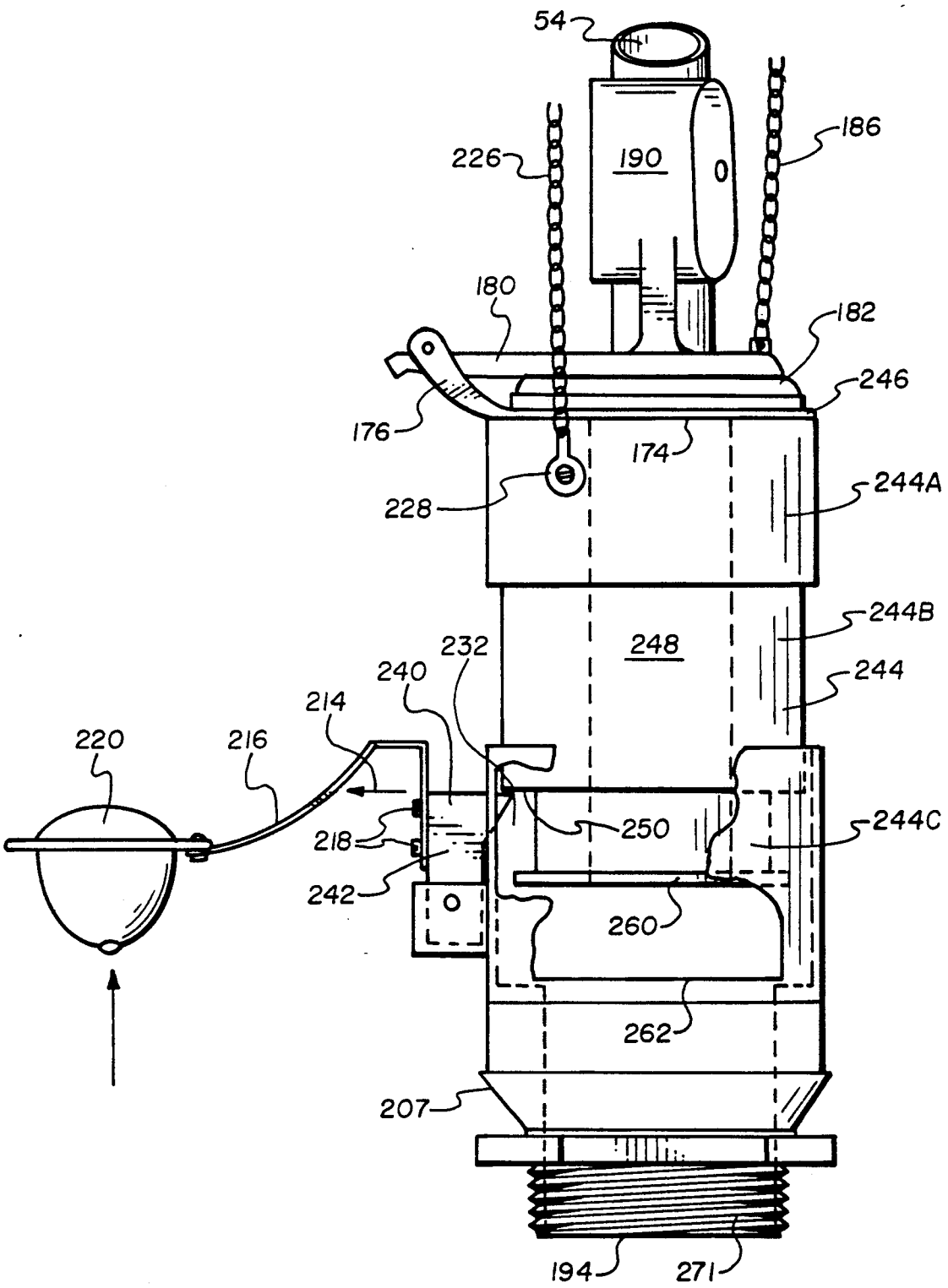
FIG. 20 is a front elevational view of the fourth embodiment, partially in section, with the second valve in an open condition.
Figure 21:
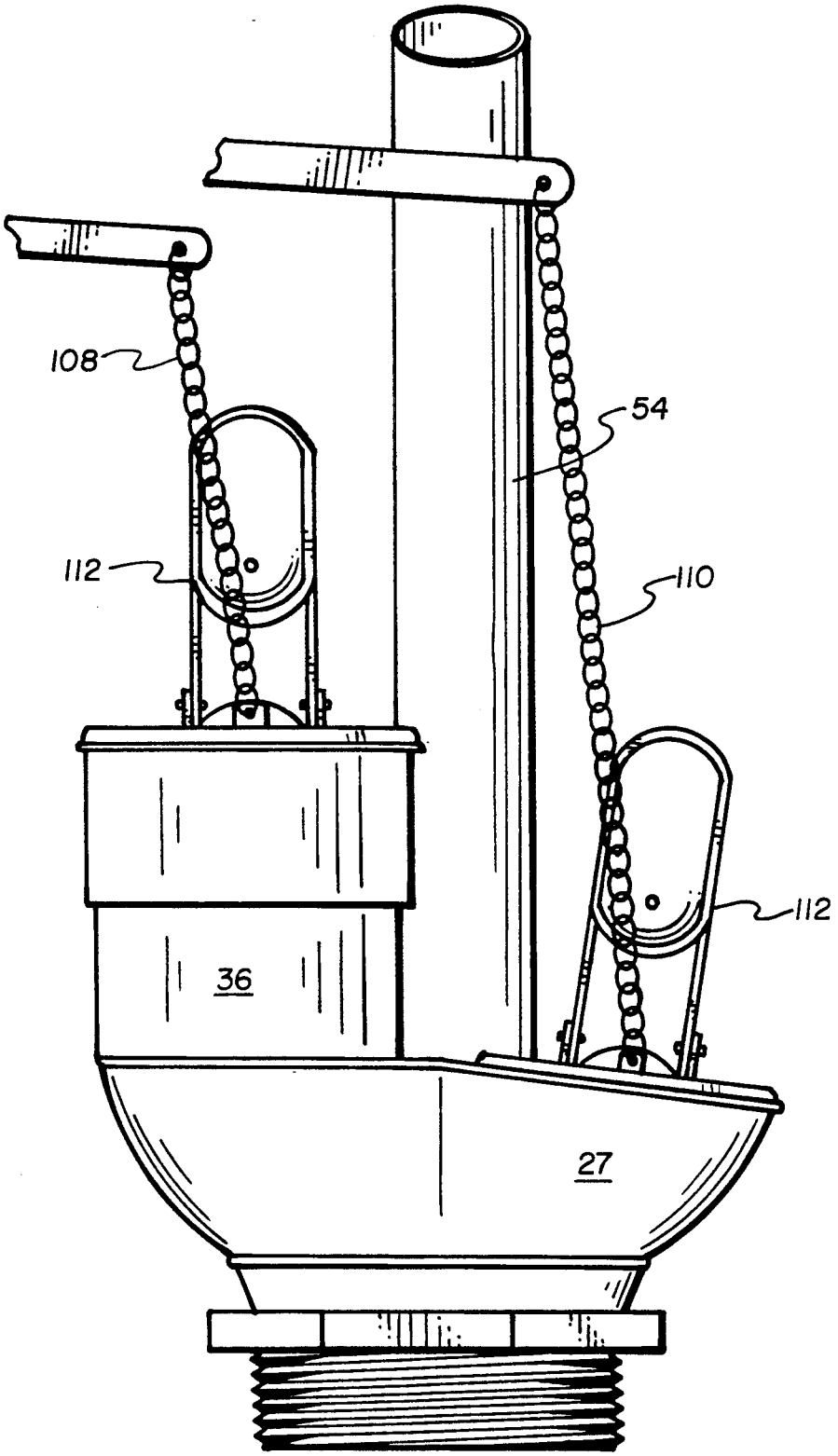
FIG. 21 is a front view of a fifth embodiment of the invention, shown in a closed orientation.
Figure 22:
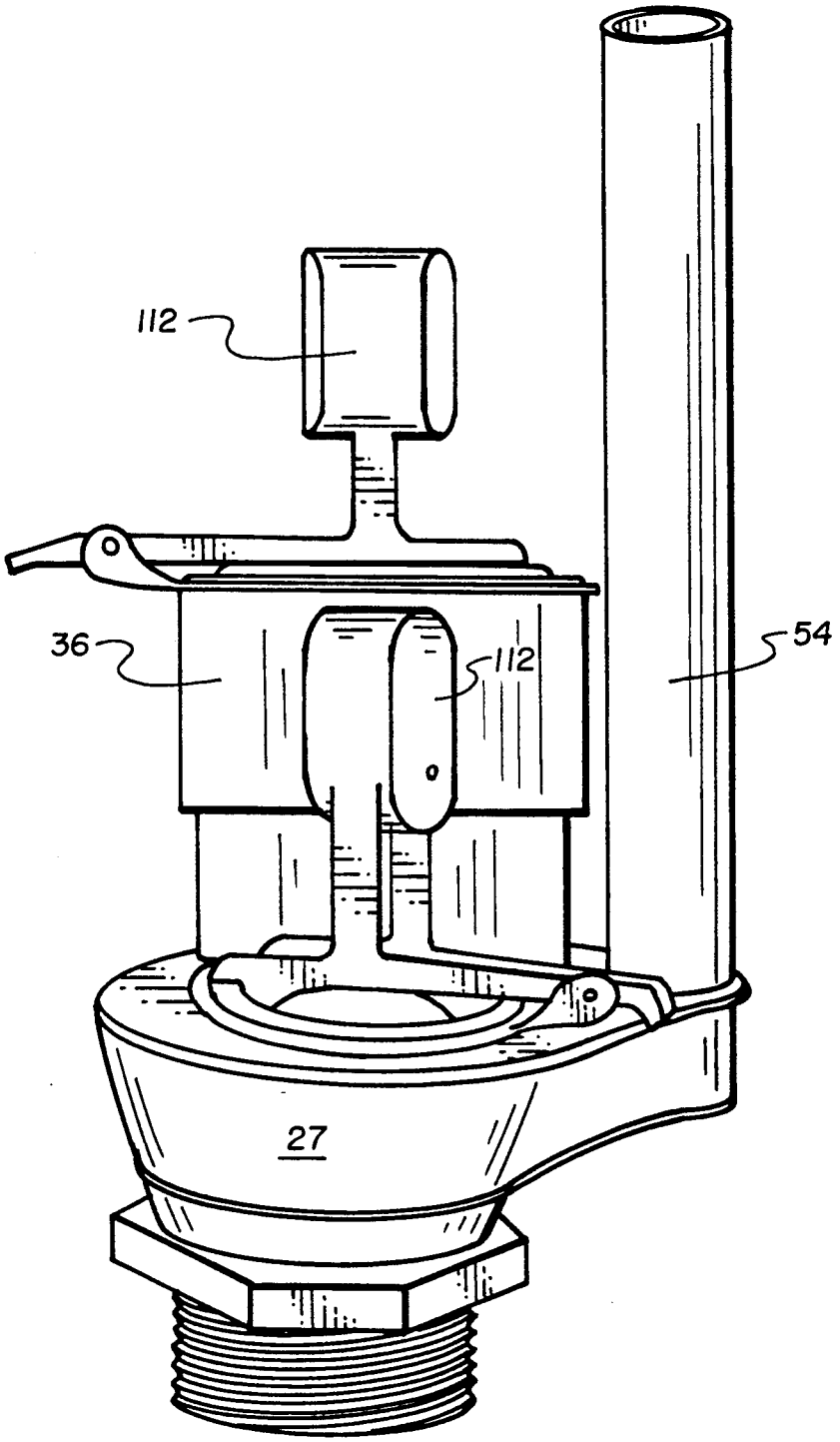
FIG. 22 is a right side view of the fifth embodiment of FIG. 21.
Figure 23:
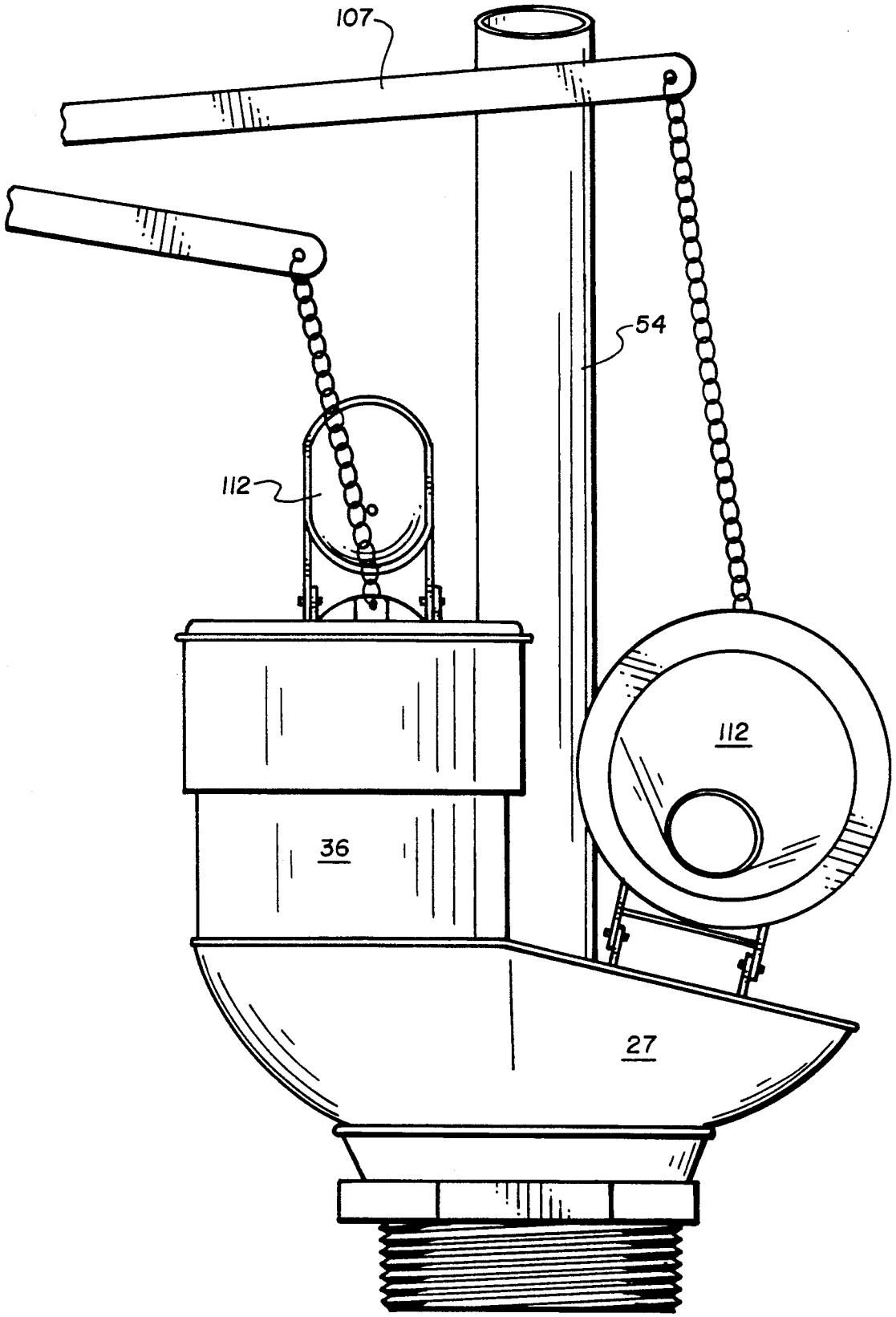
FIG. 23 is a front view of the fifth embodiment of FIG. 21 shown in a full flush, open orientation.
Figure 24:
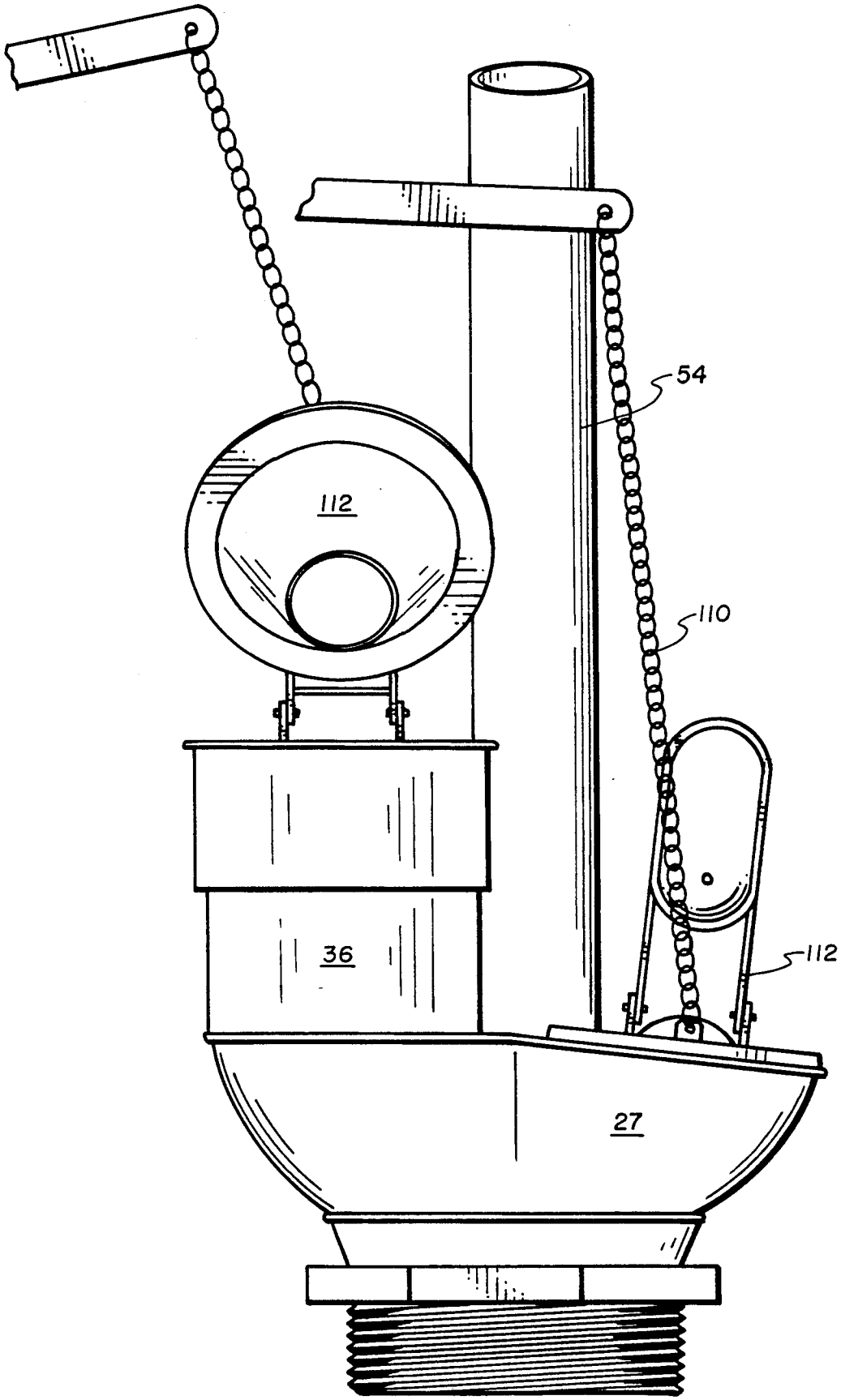
FIG. 24 is a front view of the fifth embodiment of FIG. 22 shown in a partial flush open condition.
Figure 25:
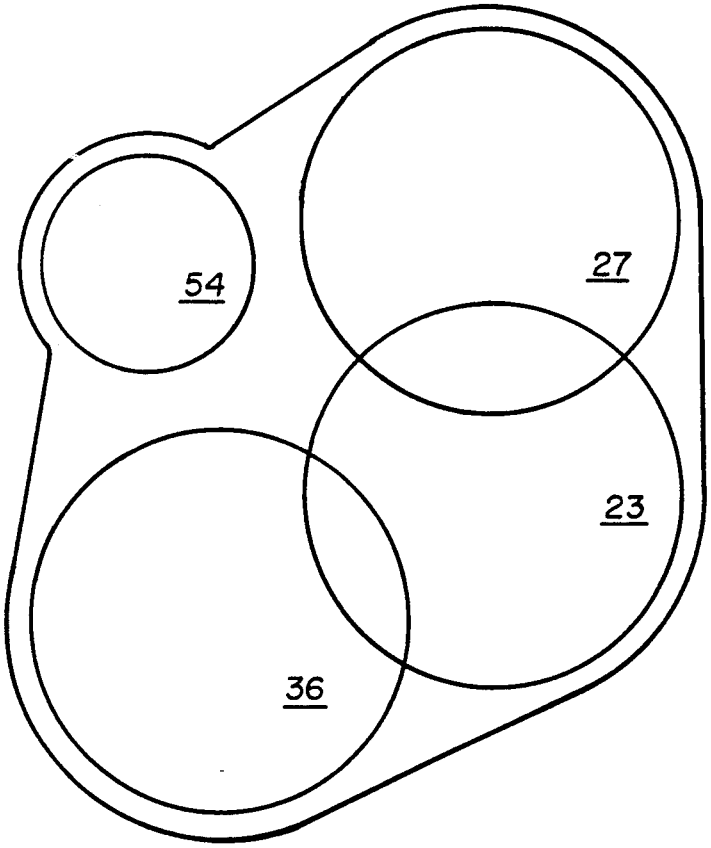
FIG. 25 is a sectional top view of FIG. 21 taken along section lines 25—25.

FIGS. 19 and 20 illustrate a fourth embodiment of the valve portion of the invention. As shown, a valving arrangement may include a tubular, upright member 230 which defines a hollow channel 232 which extends over the entire height of the member 230. The channel 232 communicates with the water outlet 194 on its lower end and with a port or open end of the member 230 on its upper end. Tubular member 230 is fixedly mounted to the base support 207, which defines the water outlet 194. The sidewalls of tubular member 230 are solid except for one or more apertures or slots 234 defined therein. Each of their slots 234 communicate the environment with the interior channel 232. The sidewall of tubular members 230 also defines an elongate, upright slot 236 therein configured to receive the flange or finger-like extension 240 of a latch 242. Slot 236 permits the extension 240 to extend through the sidewall of member 230 and into channel 232.

Latch 242 is constructed similar to latch 212 except that instead of jaws 210 and a recess well, the latch 242 includes a triangularly-shaped, e.g., wedge-like finger 240 which is biased into slot 236 by the action of float-fitted arm 216. Mounted within channel 232, coaxially with tubular member 230, is a tubular elongate upright member 244. As shown in FIG. 20, tubular member 244 may be a three-part structure. The first section, generally 244A, defines an open end 246 which forms a seat for valve head 182. Structurally, section 244A corresponds generally to tubular conduit 170. As illustrated, the valve head is pivotedly mounted to the tubular member 244A by a support structure 174. Further, an actuation chain 186 is affixed to tubular section 244A. A second upright tubular section 244B is mounted to the lower end of tubular section 244A. The outer diameter of tubular section 244B is dimensioned to be slidably received in channel 232 to form a water-tight fit, i.e., water is precluded from entering channel 232 by passage between the interior channel-defining sidewall of tubular member 230 and the exterior sidewall surface of tubular section 244B. The outer diameter of tubular section 244B is dimensionally smaller than the outer diameter of tubular section 244A.

A third tubular upright member 244C is mounted on the lower end of tubular section 244B. The association of the three tubular sections of tubular member 244 define a hollow interior channel 248 which extends from the valve seat 249 to the open free end of tubular section 244C. The outer diameter of tubular section 244C is measurably smaller than the outer diameter of tubular section 244B, thereby forming a lip or flange 250. As shown to advantage in FIG. 20, the finger-like extension 240 of latch 242 is positionable beneath the flange 250 as a means of supporting the tubular member 244. Operationally the latch 242 is similar to latch 212, i.e., the float-fitted arm 216 biases the extension 242 against the tubular member 232 when the water level in the reservoir is at or above the elevation of float 220. This biasing action urges the latch finger extension 240 beneath the flange 250 when that flange is raised above the height of the extension 240. In this orientation the latch 242 retains the tubular member 244 in its elevated orientation without the need of auxiliary support from the actuation chain 226. As the water level descends below the maximum elevation of the float 220, the height of the float urges the extension 240 outwardly from the tubular member 244, eventually disengaging the extension 240 from the flange 250. As a result of this disengagement, gravity forces the tubular member 244 downwardly, eventually causing a sealing flange 260, mounted on the lower end of tubular section 244C to engage a valve seat 262 mounted on the base support 207, which valve seat circumscribes the water outlet channel 194. The engagement of the sealing flange 260 with the valve seat 262 closes off the water outlet channel 194, thereby closing the valve.

In contrast to the third embodiment wherein the third tubular conduit 202 formed a fixedly mounted structure configured to form a guide means for the slidingly displaceable second tubular conduit 200, in the fourth embodiment, the second tubular member 232 is a fixedly mounted structure which provides a guide means for the displaceably slidable tubular member 244.

As previously stated, the coaxially mounted tubular conduits are nested within one another so as to be slidable yet also they are sufficiently tightly sealed, e.g. by "O"-rings 201 or fins mounted on the exterior surface of members 244 so as to substantially preclude, if not in fact preclude, any flow of water between adjacent tubular conduits, i.e., along the interface of such members.

The base member 207 of the valve assembly may include a male threaded lower section 271 adapted for threaded cooperation with the storage reservoir.

FIGS. 21–25 illustrate a modified embodiment of the invention shown in FIGS. 2–6. In this construction, the conduits 26 and 36 are consolidated into a single valve body wherein the respective channels of the valve are aligned in a side-by-side orientation. As shown to advantage in FIG. 25, each of the valve channels 27 and 38 each are positioned to some extent directly over the discharge port of the valve. This construction eliminates the elbow often found in two flush valves in the set. Recognizably, the new configuration defines direct, and substantially vertical channels through which the water may flow for each of the two valves. This approach minimizes energy loss due to drag forces induced by the valve walls. This elimination of energy losses obtains importance especially in the partial flow valve wherein the effect of minimizing the water flow volume can lead to flow pattern in the toilet bowl having an insufficient force to totally evacuate the bowl of waste matter. The present approach provides a means of substantially reducing energy losses which could otherwise cause a substantial reduction in flow rate and thereby diminish the operability of the system.

As further shown, the partial flush conduit 46 is fitted with a plug head having a delay means 112. Previous valve assemblies have used conventional flapper valve plugs. In operation, these valve plugs are actually sucked into a closed position 20. The water barrel in the tank descends to a level slightly above the top of conduit 46. It is surmised that the flow of the water bout the port of conduit 46 creates a vacuum which operates to induce a rapid closing of the valve plug. The applicant has discovered that this rapid closure of the partial flush valve in conjunction with the relatively small volume of water being discharged tends to cause a backwash or surging in the discharge port of the toilet bowl. More specifically, most toilet bowls have a bowl connected to a discharge port or channel which includes a trap therein. As water exits the bowl through the discharge channel, it must initially flow uphill and then subsequent to passing an apogee or hill-like formation of the flow channel it flows downward through the drain. It has become apparent that in those valve assemblies wherein the flow of water is suddenly shut off, e.g. by the rapid closure of the valve plug, the flow pattern in the bowl and discharge channel is sufficiently disrupted that a significant amount of waste material being carried by the discharge water stream is returned to the bowl due to a sudden loss of water pressure. This occurs notwithstanding the supply of water being discharged through the discharge channel by the ball cock operated water supply tube 56, i.e., through drain tube 54. Valve delay means of the type shown in FIGS. 21–24 have traditionally been adopted to permit a user to evacuate water from a tank to a level substantially equal to the elevation of the discharge port of the tank. The present invention proposes the use of such delay means fitted valve plugs for another purpose, i.e. providing a continuous diminution in the flow rate of water being discharged as the water descends to the level of the discharge port. This continuous diminution is contrasted with the abrupt cessation of the discharge flow rate which occurs with the sudden positioning of a plug in the discharge port as occurs with conventional flapper valve plugs. Under the approach of the instant invention, the rate of decrease in the flow rate within the tank discharge decreases substantially as the water level descends below the discharge port's elevation. As a result, the flow pattern in the toilet bowl is not disrupted by a sudden closing of the valve. In practice, the use of such a delay means valve has proven effective in avoiding the occurrence of surging or backwash when a small volume flush is made. The steady and continuous diminution in flow rate tends to cause the waste material to be evacuated form the bowl with sufficient momentum to clear the apogee in the bowl discharge conduit.

Through the invention may be in one embodiment fitted on both valve ports with delay valve plugs, alternative embodiments may utilize a conventional flapper valve on the full flush valve. Due to the reduced flow volume, it is only critical that a delay valve plug be used on the partial flush valve.

Observably, each of the above-referenced embodiments provides an apparatus which provides the user with an ability to select one of two pressurized flush volumes for use in cleaning a toilet bowl responsive to the type of waste to be disposed of. Each of the valving arrangements in association with the described actuation handles rely on the various means of utilizing apparatus in association with the varying surface level of the water in the storage reservoir as a means of controlling the volume of water discharged in any flush cycle.

Reference in this disclosure to details of the specific embodiment is not intended to restrict the scope of the appended claims, which themselves recite those features regarded as essential to the invention.

What is claimed is:

1. A flush valve assembly for use in the water storage reservoir of a toilet having water outlet, said flush valve comprising:

a first valve means positioned within said storage reservoir and above said water outlet, for closing said water outlet, said first valve means being associated with said water outlet for closing said water outlet;

said first valve means comprising;

an open-sided first upright tubular conduit, defining a first interior channel, mounted within said storage reservoir to communicate with said water outlet, and a first plug, pivotedly mounted to a first support member mounted within said storage reservoir, said first plug being dimensioned to be inserted into an open end of said first tubular conduit thereby closing said first conduit;

a second valve means positioned within said storage reservoir and above said water outlet, said second valve means being associated with said water outlet for closing said water outlet; said second valve means comprising;

an open-ended, upright, solid-walled second tubular conduit, defining an second interior channel, mounted fixedly on said storage reservoir, said second conduit defining at least one aperture in a sidewall thereof communicating with said second channel, said second channel communicating with said water outlet, and an open-ended, upright, solid-walled third conduit defining a third channel therein, mounted on said first conduit, said third conduit being displaceably and slidably mounted coaxially within said second conduit, wherein a first displacement of said third conduit communicates said aperture with said water outlet and a second displacement of said third conduit seals said aperture from communicating with said water outlet, a respective actuation means mounted on said first valve means and said second valve means, for individually opening said first valve means and said second valve means;

wherein upon said first valve means being opened by said actuation means said first valve means is adapted to discharge a first quantity of water from said storage reservoir, and said second valve means, upon being opened by said actuation means, is adapted to discharge a second quantity of water from said storage reservoir, said first quantity of water being measurably smaller than said second quantity of water.

2. The flush valve assembly of claim 1 wherein said first valve means is positioned elevationally higher than said second valve means within said storage reservoir.

3. The flush valve assembly of claim 1, wherein said actuation means comprises:

a handle journaled through said water storage reservoir;

a first lever, mechanically associated with said handle and said first valve means, said first lever being adapted to be actuated by a first displacement of said handle to open said first valve means; and a second lever mechanically associated with said handle and said second valve means, said second lever being adapted to be actuated by a second displacement of said handle to said second valve means.

4. The flush valve assembly of claim 3 wherein said actuation means further includes:

a first flexible member mounted on a first end to said first lever and on a second end to said first plug; and a second flexible member mounted on a first end to said first lever and on a second end to said second conduit.

5. The flush valve assembly of claim 3 wherein said second lever is a bell crank pivotedly mounted to said water storage reservoir actuated by a third displacement of said first lever.

6. The flush valve assembly of claim 1 wherein said plug is fitted with a hollow open-ended housing means adapted for buoyantly retaining said plug out of contact with its valve seat on its respective conduit until a water level in said storage reservoir becomes elevationally lower than said plug.

7. The flush valve assembly of claim 1 wherein said second channel is mounted collinearly with said first interior channel.

8. The flush valve assembly of claim 1 wherein said actuation means is positionable in two operative conditions, a first condition wherein both said first and second valve means are opened and a second condition wherein said first valve means is opened and said second valve means is closed.

9. The flush valve assembly of claim 8 wherein said actuation means further includes:

a first flexible member mounted on a first end to said first lever and on a second end to said first plug; and a second flexible member mounted on a first end to said second lever and on a second end to said first conduit.

10. The flush valve assembly of claim 9 wherein said plug is fitted with a hollow open-ended housing means adapted for buoyantly retaining said plug out of contact with its valve seat on its respective conduit until a water level in said storage reservoir becomes elevationally lower than said plug.

11. The flush valve assembly of claim 10, wherein said flush valve includes a base support mounted on said second conduit having a latching means associated therewith for retaining said third conduit in its first displacement condition until a water level in said storage reservoir has descended below a selected level.

12. The flush valve assembly of claim 11, wherein said latching means comprises:

an upright extension defining a finger, said extension being pivotedly mounted on said base support;

a bendable, semi-rigid arm having a float mounted thereon, said arm being mounted on said extension, said float being buoyant and operating to bias said extension against an exterior surface of said second conduit upon said water level in said storage reservoir being above said float;

wherein said finger is adapted to engage and retain said third conduit, thereby retaining said third conduit in its first displacement orientation.

13. The flush valve assembly of claim 12, wherein said second conduit defines a slot therein dimensioned to receive said finger and permit said finger to engage said third conduit.

14. The flush valve assembly of claim 13, wherein said float has a sufficient mass to exert a moment on said extension of sufficient force to disengage said finger from said third conduit upon a water-induced buoyancy support of said float being remove due to a descent of said water level in said storage reservoir below a selected elevation of said float.

* * * * *